US006632071B2

(12) United States Patent
Pauly

(10) Patent No.: US 6,632,071 B2
(45) Date of Patent: Oct. 14, 2003

(54) BLOWER IMPELLER AND METHOD OF LOFTING THEIR BLADE SHAPES

(76) Inventor: Lou Pauly, 460 S. 5th East, Green River, WY (US) 82935

( * ) Notice: Subject to any disclaimer, the term of this patent is extended or adjusted under 35 U.S.C. 154(b) by 0 days.

(21) Appl. No.: 10/238,712

(22) Filed: Sep. 9, 2002

(65) Prior Publication Data

US 2003/0002986 A1 Jan. 2, 2003

Related U.S. Application Data

(63) Continuation-in-part of application No. 09/726,246, filed on Nov. 30, 2000, now abandoned.

(51) Int. Cl.[7] ..... F04D 29/30

(52) U.S. Cl. ..... 416/185; 416/186 R; 416/223 B; 416/243

(58) Field of Search ..... 415/206; 416/185, 416/186 R, 223 B, DIG. 2, 243

(56) References Cited

U.S. PATENT DOCUMENTS

| | | | | | |
|---|---|---|---|---|---|
| 1,503,776 | A | * | 8/1924 | Weil | 415/198.1 |
| 2,767,906 | A | | 10/1956 | Doyle | |
| 3,267,870 | A | * | 8/1966 | Blomgren, Sr. et al. | 416/181 |
| 3,463,088 | A | * | 8/1969 | Umbricht | 415/168.2 |
| 3,478,691 | A | * | 11/1969 | Henry IV | 416/198 R |
| 3,788,765 | A | * | 1/1974 | Rusak | 415/227 |
| 4,666,373 | A | | 5/1987 | Sugiura | |
| 5,741,123 | A | | 4/1998 | Pauly | |

* cited by examiner

*Primary Examiner*—Ninh H. Nguyen
(74) *Attorney, Agent, or Firm*—Marcus G. Theodore

(57) ABSTRACT

A blower impeller employing curved radial blades defining an arc chord of 60 degrees, which circulate the air entering the circulation section to tangentially force the same through an exhaust section, wherein the multiple, overlapping, blades are of a modified Archimedes spiral design providing greater efficiency and lower generated noise.

9 Claims, 4 Drawing Sheets

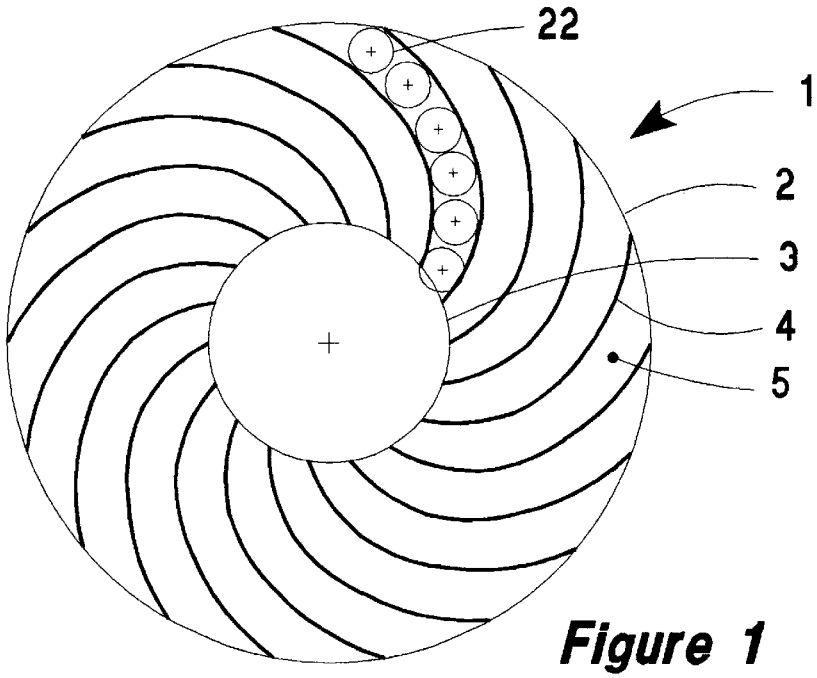
Figure 1
Figure 2
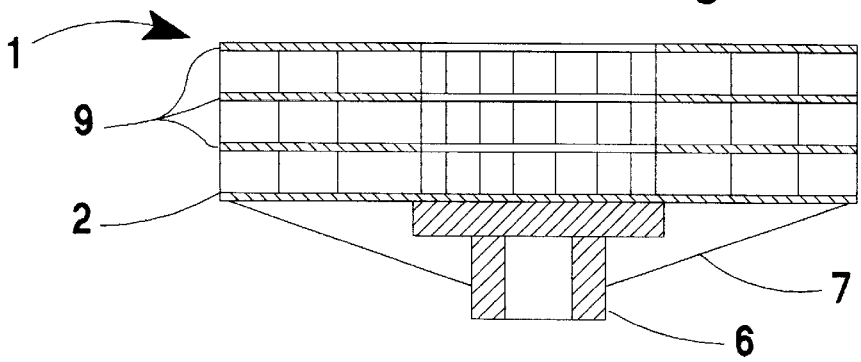
Figure 5
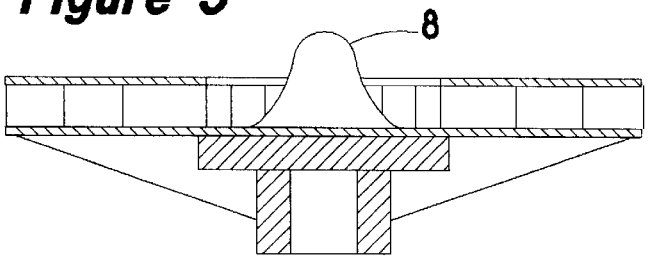

BLOWER IMPELLER AND METHOD OF LOFTING THEIR BLADE SHAPES

RELATED INVENTIONS

This invention is a continuation-in-part application of the patent application Ser. No. 09/726,246 entitled "Blower" filed Nov. 30, 2000 now abandoned.

BACKGROUND OF THE INVENTION

1. Field

This invention relates to blower and pump impellers having overlapping curved blades forming long, narrow, constant width flow channels. More particularly it pertains to a blower, which provides high flow characteristics while minimizing flow resistance. It is an impeller employing a plurality of discs having equally spaced spirally curved radial blades therebetween forming constant width and constant height flow channels, which produce a higher vacuum and pressure than previous designs. It is particularly suited for use in mineshaft and tunnel ventilation. It is also very useful where space is limited and a high volume of air is required through a small duct.

2. State of the Art

A number of blowers and impellers are known. Pauly, U.S. Pat. No. 5,741,123, hereinafter referred to as Pauly '123, describes an impeller having constant cross section area along the length of the flow channels. The constant cross section is accomplished by reducing channel height in co-operation with an increasing blade spacing thereby providing a constant cross section area. Such a configuration causes the fluid being moved to flow with a twisting motion and is not optimum for keeping Reynolds' number effects at minimum. That is, channel shape is a factor in generating turbulent flow. The present invention maintains a constant channel cross sectional shape, width, and height permitting the fluid to flow smoothly and laminar throughout the length of the flow channels. Conversely, Pauly '123, FIG. 6, shows a multi-blade overlapping configuration of impeller. This configuration is described at Column 5 lines 16–32. Pauly '123 makes no teaching about the blade shape or its span from the inlet end to the outlet end.

Eiichi Sugiura, U.S. Pat. No. 4,666,373, describes an overlapping blade impeller having constant blade height. Sugiura uses a blade of circular form and clearly teaches that the blades spacing narrows as it approaches the rim of the impeller. The present invention uses spiral blades and constant width flow channels. The Sugiura blades are segments of circles. Circular blades with any serious overlap will always converge at the impeller rim. Furthermore, Sugiura fails to teach how to determine adequate, proper, or optimum blade shape radii, or what is optimum spacing or overlap, nor how to select the circle about which the radii are arrayed. Because of the lack of design parameter teaching, it is impossible to conclude any minimum or maximum blade length and angular span as part of the Sugiura disclosure.

D. I. Doyle, U.S. Pat. No. 2,767,906, describes an overlapping blade impeller. Doyle also teaches that the spacing should narrow as the blade approaches the rim of the impeller. Moreover, Doyle (Column 5, lines 7–15) specifically states that the blades should not be parallel, nor should they diverge. The Doyle blades are segments of a spiral generated by an involute of a circle function not centered on the central axis of the impeller. Doyle specifically rejects involute blades developed around the impeller center as too long to be effective.

Pauly '123 and Sugiura do not address minimizing Reynolds' numbers and have nozzles pointing somewhat radially away from the tangent. Doyle minimizes the problem by having long sweeping flow channels (and blades), which inherently exit as near to tangential as practical. Doyle, Pauly '123 FIG. 6, and others in their drawings show flow channels spanning an arc of well over 90 degrees. None teach about an optimum length or how to conclude that the lengths shown are near optimal.

There thus remains a need for an impeller invention, which optimizes both the channel length and tangential nozzle angle by teaching the optimum span for flow channels. The present invention with a blade having unusual curvature and spanning approximately 60 degrees with flow channels starting out as Archimedes spirals and then near the periphery the channels turn inward to exit more tangentially as it would if a longer channel was utilized provides such an invention.

OBJECTS OF THE INVENTION

It is an object of the present invention to devise a blower impeller having an optimal compromise within the various conflicting parameters affecting impeller performance.

It is another object of the present invention to devise a blower impeller that runs quietly.

It is another object of the present invention to devise a blower impeller blade lofting process that does not rely on generating tables using complex mathematical formula.

It is another object of the present invention to devise a blower impeller that may be manufactured without expensive specialized tooling or machinery.

It is another object of the present invention to devise a blower impeller that can be substituted for the original equipment impeller thereby improving the efficiency of installed blowers.

Definition of Terms

Unless distinguished by the context of usage, the following general definitions apply to these terms:

FLUID: includes gasses and liquids

AIR: unless determined otherwise by context, should be interpreted as a "fluid"

BLOWER: general usage of "blower" is machinery for moving gasses, but in this context it should be interpreted as including pumps PUMP: general usage of "pump" in centrifugal machinery is for moving liquids, but here it should be interpreted as also pumping gasses.

LOFTING: a graphical process for developing shapes of products such as blades for blowers and pumps from which templates and other production tools are produced. Generally lofting is done at 1 to 1, full scale, but may be done on expanded or reduced scale.

SCROLL CASE: The collection chamber for gathering the outflow from an impeller and directing it into ducting or the like. Most scroll cases are formed in one of several known spiral shapes.

MOTOR: Any source of rotating power including, but not limited to electric, hydraulic, pneumatic motors, turbines, engines, and transmission systems between the power source and the impeller.

ARCHIMEDES SPIRAL, or SPIRAL OF ARCHIMEDES: A spiral that increases radius proportional to the angle turned. The formula for an Archimedes Spiral is R=K*(theta) in polar coordinates. Where R is the distance of the point from the center of generation. In this case, the center of the impeller disk, and theta is the angle turned from the polar origin (r=0, theta=0). It is therefore intended that the term "Archimedes Spiral" refers to blade shapes defined by the Archimedes Spiral formula, or other equivalent spiral formulae, where the spiral shape is defined by a plurality of curved or straight line segments approximated by the formulae.

SUMMARY OF THE INVENTION

The present invention comprises two parts:

First, it is directed to a blower impeller for installation within an operating housing. In most uses, the operating housing will have a lateral central housing air intake in communication with an interior circulation chamber containing the impeller, a peripheral air collection chamber, and a tangential exhaust. A drive shaft is journal mounted to the housing to extend within the circulation chamber and attached to the center of the impeller opposite the air intake. FIG. 6 illustrates the impeller installed in a common "snail" housing.

Second, it is directed to a method of lofting a specialized blade shape for production of impeller blades for the blower.

The present invention provides low turbulence flows with low Reynolds' numbers. The enemies of efficient impeller design are turbulences associated with high Reynolds' numbers, turbulences associate with exit streams crossing the flow in the collector scroll, surface drag (boundary effects) along the walls of the fluid flow channels, cavitation, entrance geometry at the inlet of the impeller flow channels, and inadequate inlet area in the impeller inlet eye. Reynolds' number effects are controlled primarily by the narrowest dimensions of rectangular flow channels, the fluid velocity through the channels, and the viscosity of the fluid. Decreasing the spacing between blades improves the Reynolds' number, but increases the interior surface area causing increased surface effect drag. All impeller blades forms have exit nozzles discharging the working fluid with a radial component of velocity. The radial component causes turbulence in the receiving plenum of the pump or blower case and should be held minimum consistent with the basic design of the impeller. To prevent the fluid exit stream from having significant radial velocity crossing the scroll flow, the flow channels should direct the exit stream as close to tangential as practical. This is primarily controlled by the direction of the exit nozzles, which point somewhat tangentially from the impeller rim. Surface drag is a function of flow velocity, but more importantly, of the total "wetted" area in the flow channels. The best control of wetted area is to keep the length of the flow channel as short as practical.

The low turbulence impeller of the invention comprises at least one disk for attaching a set of air-moving blades and attached to a shaft. The blades are uniquely shaped to define constant width spaces between adjacent blades extending from the collection chamber to the proximity of the rim of the attachment disk, and occupying an chord arc of 60 degrees.

A motor drives the shaft to turn the impeller and circulate the air through the blower. A typical motor utilized for air circulation will turn at about 3000 rpms to provide a high volume of air through a small duct. Thus configured with equidistantly spaced blades, the blower provides at least 20% greater efficiency than those where the blades are spaced apart wider at the outlet.

The impeller is attached to a shaft by any of many known methods. Small impellers often are attached by compression between a shoulder on the shaft end and a nut turned onto a threaded portion extending from the shoulder. Larger and heavier impellers may require an attachment hub and support ribbing.

In the simplest embodiment, there is only one disk to which the blades and shaft are attached. The housing itself serves as the cover of the fluid channels A second parallel circular disc may be attached to the blades opposite the attachment disk to form a closed impeller. The second impeller disk has a central air intake opening aligned with and in communication with the housing fluid inlet.

In another preferred embodiment, the impeller is constructed of more than two parallel circular discs with central air inlets having similar shaped blades affixed there between.

In a preferred embodiment for use in tunnels, mines, and lumber mills, the discs and blades are spaced sufficiently apart to prevent debris picked up in the intake air from obstructing the flow channels. This spacing is particularly important where very large blowers with high velocity airflows are employed. Preferably, the angle of curvature of the blades at the gas inlets is also selected to allow the air entering the impeller to be at approximately the same angle as the curve of the blades to minimize inlet losses. In addition, the flow channels have the same cross-section area throughout their length to prevent turbulence in the air flows passing through and out the blade air outlets.

The preferred impeller blade design has the blades of the impeller curved on a cord of sixty degrees. This allows for maintaining the distance between the blades at a constant distance from the center of the impeller to the outside edge, thereby maintaining the pressure while reducing the turbulence of the air. This is accomplished by dividing the circumference of the outer circular impeller blade drive base into 10 degree radii. Five equidistant concentric circles are then drawn with diminishing radii to serve as layout guides. The fifth inner circle locates the inner end and the outer circle locates the outer end of the blades to be drawn. The first curved blade segment shape is then drawn by connecting a series of intersection points of the 10 degree radii with the inner, outer and four equidistant intervening concentric circles with a French curve. The first point is the outer circle intersect at the 60 degree segment. The second point is the fourth inner concentric circle intersect with the 50 degree segment. The third point is the third inner concentric circle intersect with a 30 degree segment. The fourth point is the second inner concentric circle intersect with the 20 degree segment. The fifth point is the first inner concentric circle intersect with the 10 degree segment. The sixth point is the inner circle intersect at the 0 degree radius. These six points form the extended radial edge of the outside edge of the impeller blade proximate the air inlet, which gradually changes in curvature toward the outside edge of the impeller blade proximate the air outlet. The next circular blade is then drawn parallel to the first blade starting from the width of the inner blade opening between the adjacent blade, and ending 60 degrees from its extended radius of the edge of the next inner blade.

The layout method is straightforward and independent of the tools. It uses either manual methods of drafting or equivalent automated methods employing computer software, such as AUTO CAD where many blades are employed. Although automated methods are much faster and provide more detailed drawings, the layout method does not require extensive calculations and the plotting of long tables of data points. It also can be accomplished with or without the actual formulae plots.

The impeller may be made using welded, machined, riveted, or spot construction. The choice employed would be determined by the thickness of the material used and the purpose of the blower. For example, a blower used for ventilation could have the blades spaced closer together if air carried debris is not a factor. If debris is a factor, it may be necessary to get in between the blades for clean out. Pop rivets may be employed for this purpose to easily separate and reassemble the components. In other embodiments, the components may be preformed as single pieces assembled by injection molding. Where weight is a factor, a titanium or aluminum type of slug with a center inlet air opening and slots for the cover machined to specification. A computerized milling machine is then programmed to cut a cord of 60 degrees between each blade to form one piece construction with the back of the impeller laid flat on the milling machine. The impeller cover, if used, is then assembled onto the impeller.

Preferably, the tangential exhaust of a housing is structured for coupling with a hose or conduit to transmit the blower air flows. In larger embodiments, the tangential exhaust couples directly with large ducting to deliver the air flows.

The blower invention thus provides a new highly efficient blower configuration, which directs high volumes of air into a given space.

DESCRIPTION OF THE DRAWINGS

FIG. 1 illustrates a plan view cross section of the impeller showing the installed blower blades FIG. 2 illustrates a side cross sectional view of a stacked set of impeller blades and mounting hub.

FIG. 5 illustrates a side cross sectional view, including a flow directing spinner.

INDEX OF DETAILED COMPONENTS

Figure 3:
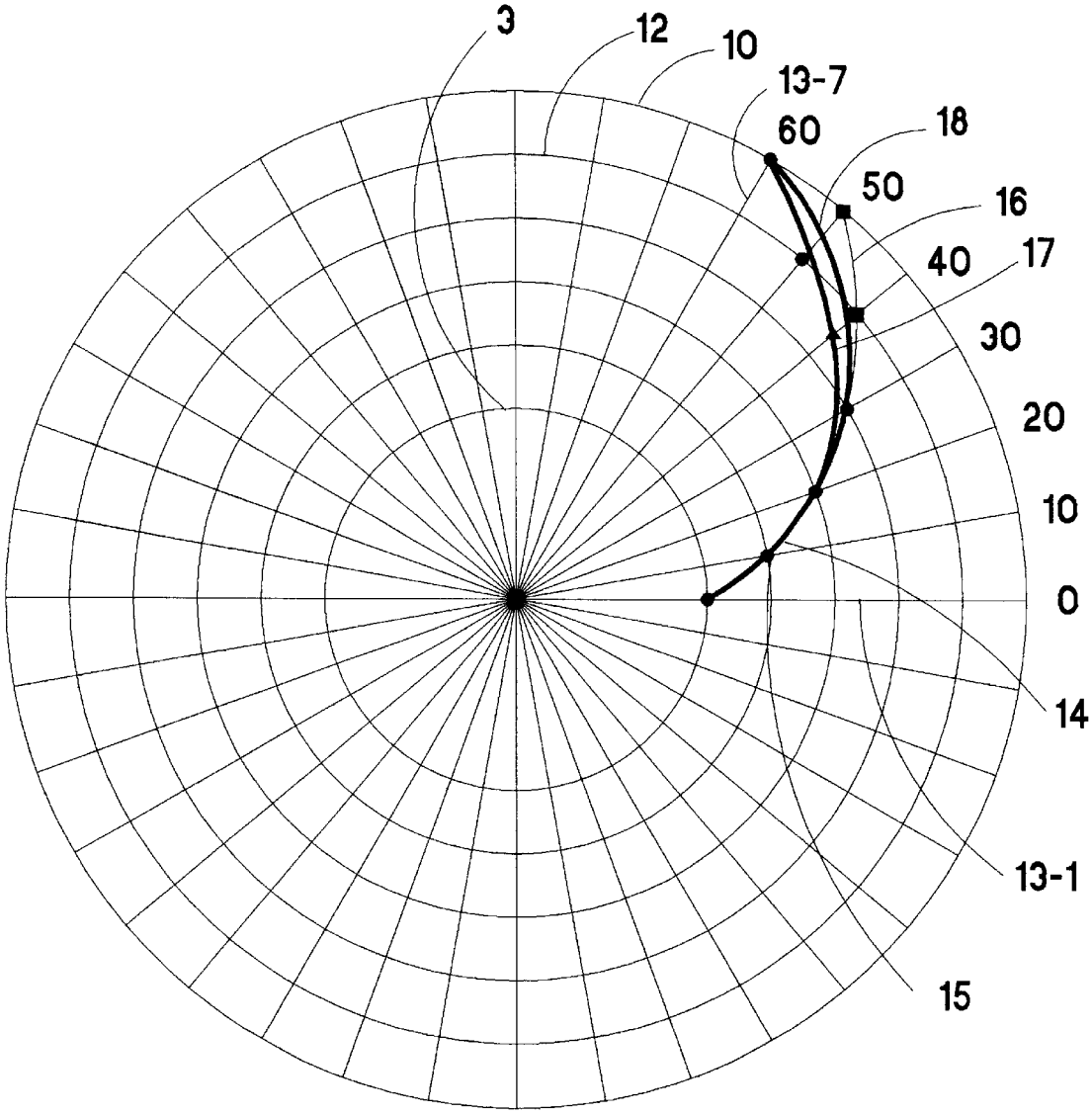
FIG. 3 illustrates a view of lofting procedure using minimum layout points.

The following number citations to the detailed components are employed in the description of the illustrated embodiments, unless otherwise specified:

1. Impeller, generally

2. Flat circular base, and/or rim thereof

3. Locus of blade inner endings.

4. Impeller blade

5. Impeller fluid flow channel

6. Hub for attaching a shaft to the base disk.

7. Stiffening rib

8. Inlet fluid guiding spinner

9. Impeller cover or intermediate disk with inlet eye.

10.

11. Locus of outer blade endings

12. Intermediate polar plotting grid circles

13-1 through 13-7 polar plotting grid radii

14. Inner portion of blade following a curve of an Archimedes spiral.

15. Plot points (round dots) on an Archimedes spiral.

16. Pilot points (square dots) on an extended Archimedes spiral

17. Estimated point (triangular dot) on or near a modified spiral segment

18. One modified spiral segment.

19. Another modified spiral segment.

20 Finer scale polar plotting grid circles

21 Finer scale polar plotting grid radii.

22. Channel width measurement circles.

23. Blower assembly

24. Blower collector plenum

25. Blower exit orifice

26. Blower inlet chamber.

27. Blower scroll case assembly

DESCRIPTION OF THE ILLUSTRATED EMBODIMENTS

Referring to FIG. 1, impeller 1, is a disk having an outer rim 2, and an inner circle 3 marking the positions of the inner ends of blades 4. As shown, blades 4 spirally extend from the inner circle 3 to the outer rim of a flat circular base 2. A plurality of identical blades are arrayed in equal angular spacing around the common centers of circle 3 and rim 2, thereby forming a series of channels 5 through which the working fluid is urged by centrifugal forces generated by rotation of the disk and blades.

FIG. 1 may be interpreted as a view of the impeller with the cover disk removed, or of an impeller intended for open-face use where the pump casing (not shown) serves in place of the cover disk. It is to be understood that both the pump case and any cover disk will have a hole roughly corresponding to the circle 3 for admitting intake fluids to the impeller.

Referring to both FIGS. 1 and 2, a cover disk 9, if used, will have diameter equal to the base disk. Common pump design suggests that the entrance hole, called the "eye" has an area at least 1.25 times the combined areas of the inlets of the flow channels S. The inlet fluid will enter perpendicularly to the base disk, and then turn sharply to gain entrance to the impeller blades, thus creating efficiency robbing turbulence. Therefore, a spinner 8 as shown in FIG. 5 may optionally be added to direct the inlet fluid flow more smoothly into the impeller blades. The spinner may also incorporate a treaded nut function to bolt the shaft to the rotating assembly and/or be part of the shaft attachment to the disk means.

FIGS. 2 and 5 are cross sections of the impeller disk and further show how several sets of disks may be stacked using a plurality of cover disks 9 to control turbulence generation as identified by using the Reynolds' number equation as an analysis tool. These figures also show a generic hub assembly 6 and an optional stiffening rib 7. The hub 6 as illustrated represents any of several known means to attach a shaft to a disk. Obviously, the stiffening rib 7 should be avoided, when possible, as it can be a source of considerable drag.

The blades shown in FIG. 1 are uniquely designed with the inner portion being an Archimedes spiral. The blade curvature then departs from an Archimedes spiral form, turning more concave to form a shape that is characterized by an ability to maintain essentially constant width between blades arrayed as a set around the center of the impeller, and to have exit nozzles directed more tangentially along the impeller rim than is possible with a pure Archimedes spiral.

Refer to FIG. 3 for illustration of the points of construction, the preferred method of lofting the impeller blade of this invention is:

1. Draw two concentric circles. The first 3 of which is the locus of the inner ends of the blades, and the other 11 is the locus of the outer end of the blades. The diameter of the inner circle 3 should be at least ⅓ the diameter of the outer circle 11. The outer circle 11 will be approximately congruent with the base rim.
2. Draw 4 equally spaced circles 12 between the inner and outer circles.
3. Draw at 7 radii spaced 10 degrees apart from 0 through 60 degrees inclusive, 13-1 to 13-7. This constitutes a polar plotting grid upon which the Archimedes spiral and variation will be drawn.
4. Mark the intersections of the first 4 radii (0 to 30 degrees) 14 and each successive circle, starting with the inner circle.
5. With a French curve or similar, connect the 4 points with a smooth curve. These 4 points are points on an Archimedes spiral 14 where the radial distance increases in proportionally with the angle turned. The 40 and 50 degree points may optionally be marked (squares 15) to extend the Archimedes spiral to the rim for comparison with the final blade shape.
6. Mark the crossing of the fifth circle and the 50 degree radius
7. Mark the crossing of the outer circle and the 60 degree radius.
8. Optionally mark the midpoint on the 40 degree line between the third and fourth circle (triangle 17 at point 3.5, 40). This point has been found to be very close to being on the adjusted curve described below.
9. With a French curve or similar, draw a smooth compromise curve between the 60, 50, 40, 30, and 20 degree points, fairing the inner end smoothly into the Archimedes spiral previously drawn. The outer end should terminate on or in the vicinity of the 60 degree point, the inner end should terminate in the vicinity of the 20 degree point.
10. Draw a congruent blade shape curve radially offset from the first by the 360/n degrees. Where n is the number of blades to be used in the impeller design.
11. Check the spacing between the curves. If the spacing is not constant along the majority of the length of the blades, then repeat steps 9 through 11. A slight narrowing at the inner end is permissible. The narrowing at the inner end will be decreased by enlarging the inner circle.
12. When a satisfactory blade has been lofted using the preceding steps, draw a parallel copy of the curve offset by the thickness of the blade, then draw a set of "n" blades equally offset in the radial direction to complete lofting of the intended impeller. The curved shape thus drawn is specifically the leading and trailing edges of a blade having approximately uniform thickness as shown in the FIGS. Small localized adjustments in the blade thickness may be made to overcome small residual widening or narrowing of the flow channels resulting from compromises in shape due to approximations and curve fitting during the lofting procedure.

The above layout of the parallel blades is bound by a ratio of the size of the inlet to the outside diameter of the impeller of about 2 to 3 times the diameter of the inlet to the outside diameter of the inlet for the blades to be parallel with a ratio of 1 to 2 being the preferred ratio embodiment. If required, the inner limit could be a ratio of 2 to 3 of the outer circle. The outside of the impeller may exceed that ratio due to the auger or boat impeller mechanical advantage that utilizes the rpm of the impeller and the centrifugal force of a larger diameter out side impeller. The evenly spaced blades utilize the maximum volume of area coming from the center area. The recessed back curve then piles up the mass to further increase the velocity of the air or fluid flowing threw it.

Figure 4:
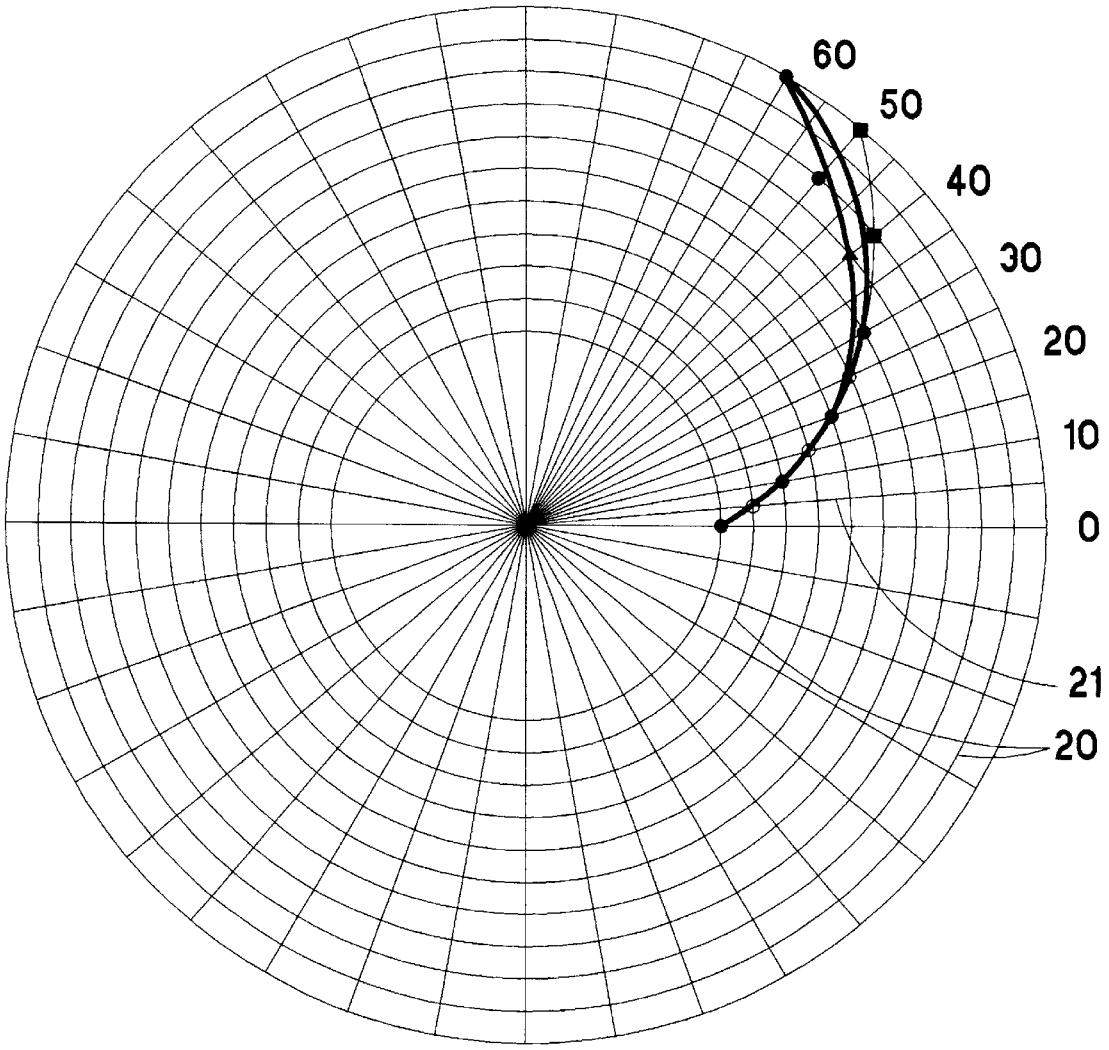
FIG. 4 illustrates a view of lofting procedure using many layout points.

The above method approximates the shape of an involute of a circle over the outer portions of the blade without preparation of a table of points or encountering the difficulties and errors of trying to draw an involute via the string and pencil method employing a string wrapped cylinder, which is unwrapped to draw the curve. There is no purely Euclidean or direct plotting method to draw an involute. The Archimedes curve of the inner portion places the inner tip of the blade facing forward into the direction of rotation thereby scooping the working fluid from the impeller eye into the flow channels. An involute at the same place would point the blade ends directly toward the center of the impeller, which requires inefficient turning of the working fluid as it enters the channels. Some experimentation is needed to compensate for variations caused by various ratios of inner and outer starting circles. Curves 18 ending at or near the 20 degree point have been found quite satisfactory and are nearly parallel, sometimes having a negligible bulge in the midsection or negligibly expanded at the outer end. Curves 20 ending at or near the 30 degree point have been found to be slightly narrowed at the outer end. When finer detailed lofting is desired, additional radii and circles may be inserted between those described above. The added intermediate circles and radii should be in equal number and evenly spaced between the 6 circles and 7 radii described above. FIG. 4 illustrates insertion of one additional set of grid lines between the lines previously described. Details 20 and 21 are representative of all the added grid lines. The open circles shown in FIG. 4 are the new intersections of interest in the described construction.

Note, that the polar plotting grid described may not be "regular", that is, the plotting circles may or may not be extrapolated back to the center with even spacing. This is equivalent to starting an XY plotting grid at some origin other than 0,0. Also, the radius described herein as 0 degrees is not the same zero that is used in the defining formula for an Archimedes spiral, but is also offset. The angles described are correct relative to each other and serve as descriptors, not simple solutions to the R=K*(theta) formula. The Archimedes spiral developed graphically herein may be represented by formula if the proper offset terms are added to the basic formula for an Archimedes spiral. It is not necessary to do so when using the method taught herein.

Flow channel width is best measured by sliding a close fitting circle 22 through the channel. Measurements perpendicular to either blade are generally adequate, but since points on opposite blades are on different points of the blade curvatures, a perpendicular extending from one blade will not be perpendicular to the corresponding measurement extended from the other blade. Hence, the circle is the best method of checking channel width. A cylinder such as the shank of a twist drill is ideal for checking the channels of hardware impellers made with the described method. Also, the shapes of the blades when applied to the mounting disk (in drawings) give rise to optical illusion that confuses the eye for "eye balling" measurement of channel width. How many blades and the optimum spacing between the blades is a compromise of many parameters starting with the volume of flow and the pressure to be developed. More blades and narrower flow channels improves the effective tangential angle exit nozzles and promotes more laminar flow. Opposing these improvements, are greatly increased surface drag within the channels and a decrease in available area for the flow channels because of the increased space taken up by the blades.

Other Embodiments and Variations

The central eye of the cover disk should be approximately the diameter of the locus of the inner ends of the blades. It may be somewhat smaller or larger depending on the specifics of the task for which the impeller is being designed.

The inner tips of the blades may be extended into the eye zone and optionally turned in the direction of rotation to scoop up the fluid within the intake eye. An extension would likely result in narrowing channels, but this would be permissible because the air entering the impeller channels would be entering from both the end openings and directly into the open tops of the extension. Any extension applied to an impeller otherwise constructed using the shapes taught herein is not to be construed as part of the claimed invention.

In another preferred embodiment, the impeller has the second portion of the impeller blade also shaped as an Archimedes spiral. The outer curved portion of the optimum blade is, in most cases, an Archimedes spiral having different K factor and offset than the inner segment. Previously described points at the polar coordinates 6,60, 3.5,40, and 3,20 are on this spiral. The radial increase is 0.75 of circle spacing for every 10 degrees, which is compatible with the definition of an Archimedes spiral. For plotting accurately, if is recommended that additional points be plotted by drawing radii at 5 degree intervals and 3 or 7 intermediate circles (which will be at 0.25 or 0.125 interpolated coordinates) between at least the main circles numbered 6, 5, 4, and 3. Locate points 6,60, 55,5.625, 50, 5.25, 45, 4.825, 40,4.5, 35,4.125, 30,3.75, 25,3.375, and 20,3. Additional points may be interpolated or more grid and circle coordinate lines drawn in. The points are then connected with a smooth curve. Fairing may be required at the intersection of the first and second spiral segments.

The invention taught here may or may not include a top cover disk and/or intermediary disks as shown in FIG. 2. An open face, uncovered, impeller is common in pump design, and such a configuration may use the present blade design as well. The functions of the cover would then be performed by the pump casing itself.

The impeller may be mounted in any of the ordinary pump or blower housings including directly within a plenum, and the impeller may be rotated in either direction. The effects of the direction of rotation relative to blade curvature on pump or blower performance are well known. This particular design is expected to generally respond to direction of rotation in the same manner.

How to Use the Invention

Figure 6:
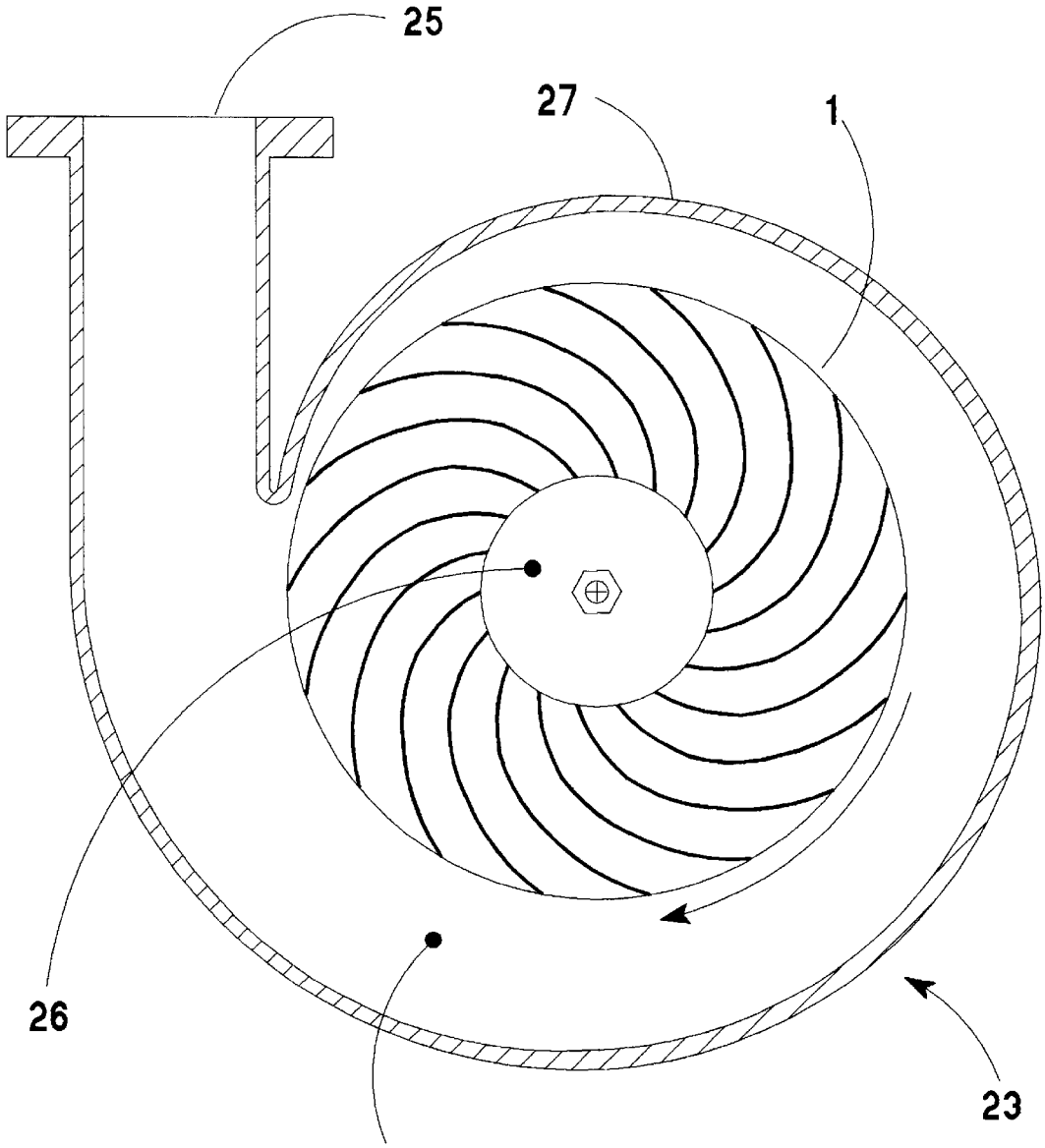
FIG. 6 illustrates a cross section view of the impeller installed within a typical scroll case.

FIG. 6 illustrates the disclosed impeller mounted in an ordinary scroll case type blower assembly 23. The impeller 1 is rotably mounted in a case housing 27, which has operable connection 26 to the source of fluid being moved, a collection plenum 24, an exit opening 25, which is usually an operable connection to the duct work or plenum where the moved fluid is utilized, means to attach a motor for rotation, and mounting means to attach the pump or blower to the surrounding utility structure. The impeller is rotated at suitable speed to perform the task assigned, and by a combination of centrifugal force and blade and channel angle, fluid is moved under pressure from the source to the utilization chamber.

The impeller may be rotated in either direction. With the exit jets pointing backwards away from the direction of rotation as shown in FIG. 6, or with the jets pointing forward relative to the direction of rotation.

Thus constructed, the impeller mounted in a cooperating case provides high flow characteristics while minimizing flow resistance.

Although this specification has referred to the illustrated embodiments, it is not intended to restrict the scope of the claims. The claims themselves contain those features deemed essential to the invention.

I claim:

1. An impeller for a blower comprising:

a. a base disk having a center, and an outer rim, and means for attaching a shaft for rotating the disk, b. a first plurality of curved blades of substantially constant height and substantially constant thickness attached to said base disk with said blades i. being equally angularly spaced around the center of the disk and extending from an interior circle to the proximity of the outer rim, and ii. each blade having a curvature adapted to define a plurality of channels having substantially constant width and substantially constant height between adjacent blades, and iii. said blades each extending over a chord arc of approximately 55 to 70 degrees chord angle, and iv. said blades each having a first curved portion extending outwardly from said interior circle and curved to conform to an Archimedes spiral, and v. a second curved portions curved more concavely away from an extrapolation of said Archimedes spiral from of the first portion, and joining said first portion in a smoothly faired alignment, and whereby said base disk and the interior ends of the blades define a central intake portion of the impeller for receiving a fluid and directing the fluid into the interior ends of said channels, such that when said impeller is rotated in a fluid media, fluid is drawn from the central intake portion and directed through said channels and expelled from the rim end into a receiving plenum.

2. The impeller of claim 1, wherein the second portion of the impeller blade is also shaped as an Archimedes spiral.

3. The impeller of claim 1, including a cover disk covering the impeller, said cover disk further comprising a central opening adapted for admitting fluid and directing it into the said central intake fluid receiving portion.

4. The cover disk of claim 3, including a second plurality of blades attached to the side opposite the first plurality of blades.

5. An impeller blade for a blower comprising:

i. an elongated blade with first and second opposite ends, a substantially uniform thickness, and a substantially uniform width, and ii. a first curved portion extending from said first end toward said second end, and iii. a second curved portion extending from said second end and joining said first curved portion with a faired alignment thereby forming a continuous smooth curve from said first end to said second end, and wherein said first curved portion being defined as a segment of an Archimedes spiral, and said second curved portion having increased concave curvature, and iv. said blade being adaptable for use in a plurality of equally angularly spaced blades mounted on a rotating circular disk having a center and outer rim with the said blades extending from the interior of the disk with said second end being proximal to the outer edge of the disk, thereby forming an impeller for a blower, and iv. said curved portions adapted to define a space having substantially constant width between adjacent blades in the plurality of blades, and vi. each blade of the plurality of blades extending over an arc chord angle of approximately 55 to 70 degrees.

6. The impeller of claim 5 wherein the locus of the terminations of said first ends of the plurality of blades is a circle concentric with the outer rim of said disk, and having a diameter of at least ⅓ the diameter of said disk outer rim.

7. The impeller of claim 5 including means for attaching a shaft to the mounting disk for rotating said mounting disk.

8. The impeller of claim 5, including a cover disk attached to the blades opposite to the mounting disk, and having the same diameter as the mounting disk and having a centrally located hole for admitting fluid to the flow channels defined by the disks and blades.

9. A method of lofting an impeller blade for a blower comprising the steps of:

a. drawing an outer circle scaled to represent the radial extent of an impeller blade, b. drawing an inner concentric circle at least ⅓ the diameter of the outer circle, scaled to represent the starting point of an impeller blade, c. drawing four concentric evenly spaced circles between the inner and outer circles, thereby defining six circles with diameters increasing by equal amounts, and d. drawing at least 7 radials from the common center to the outer circle, spaced apart by 10 degrees, e. designating one radius as 0 degrees, and the next 6 radii as 10 through 60 degrees, and designating the inner circle as 1, and the others as 2 through 6 as references for locating points in the form 1,20 on the polar graph drawn thusly, where the first number is the circle and the second number is the radius, f. locating the progressive points of intersection of the first 4 circles and the first four radii; the coordinates of these points are 1,00, 2,10, 3,20, and 4,30 g. skipping over the point at 5,40, h. locating points at the progressive intersections of the 5th circle and the 50 radius, and the outer circle and the 60 radius, the coordinates of these 2 points are 5,50, and 6,60, i. optionally locating the point on the 40 radius midway between the 4th and 5th circles, the coordinates of this point are 4.5, 40, and j. drawing a smooth curve between the 4 points located in step f, thereby drawing a segment of an Archimedes spiral, k. drawing a smooth compromise curve between the points located in steps h and i and the point located in step f designated as 4,30, said compromise curve starting in the proximity of point 6,60 and ending in the proximity of point 3,20, and l. joining the curve of steps j and k with a smoothly faired alignment.

* * * * *